US011453047B2

(12) United States Patent
Tanaka et al.

(10) Patent No.: US 11,453,047 B2
(45) Date of Patent: Sep. 27, 2022

(54) METHOD FOR PRODUCING SALT CORE

(71) Applicant: TOYOTA JIDOSHA KABUSHIKI KAISHA, Toyota (JP)

(72) Inventors: Yoshitaka Tanaka, Toyota (JP); Masafumi Nishida, Okazaki (JP); Yuta Takahashi, Toyota (JP); Yuji Kayashita, Seto (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 63 days.

(21) Appl. No.: 17/067,079

(22) Filed: Oct. 9, 2020

(65) Prior Publication Data

US 2021/0187596 A1 Jun. 24, 2021

(30) Foreign Application Priority Data

Dec. 23, 2019 (JP) ..... JP2019-231698

(51) Int. Cl.
*B22C 9/10* (2006.01)
*B22C 1/00* (2006.01)

(52) U.S. Cl.
CPC ..... *B22C 9/105* (2013.01); *B22C 1/00* (2013.01)

(58) Field of Classification Search
CPC .. B22C 9/105; B22C 1/00; B22C 3/00; B22D 17/2007
See application file for complete search history.

(56) References Cited

U.S. PATENT DOCUMENTS 5,303,761 A * 4/1994 Flessner ..... B22C 9/105 264/328.2
2003/0155450 A1* 8/2003 Renkl ..... B05B 3/1014 239/587.1
2009/0250587 A1 10/2009 Käfer et al.
2017/0320129 A1 11/2017 Bischofberger

FOREIGN PATENT DOCUMENTS

| | | | |
|---|---|---|---|
| CN | 107214304 | A | 9/2017 |
| DE | 10 2006 046 792 | A1 | 4/2007 |
| DE | 10 2013 007735 | A1 | 11/2013 |
| DE | 102013009055 | A1 | 12/2014 |
| JP | 07-195148 | A | 8/1995 |
| SU | 921662 | A1 | 4/1982 |

OTHER PUBLICATIONS

English machine translation of Fuchs et al. (DE 102013007735 A1) (Year: 2013).*
Partial English Translation of Communication dated Jul. 5, 2021, from the Russian Patent and Trademark Office in application No. 2020132291/05(058746).
Partial English Translation of Notification of First Office Action dated Apr. 21, 2022, from the Chinese Patent Office in Chinese Application No. 202011296373.X.

* cited by examiner

*Primary Examiner* — Keith Walker
*Assistant Examiner* — Steven S Ha
(74) *Attorney, Agent, or Firm* — Sughrue Mion, PLLC

(57) ABSTRACT

A method for producing a salt core includes a step A of adding a saturated sodium chloride aqueous solution to a sodium chloride crystal that is granular, to prepare a slurry mixed material of sodium chloride and water, a step B of subjecting the slurry mixed material to pressure molding to obtain a molded article, and a step C of drying the molded article to remove moisture.

7 Claims, 10 Drawing Sheets

METHOD FOR PRODUCING SALT CORE

INCORPORATION BY REFERENCE

The disclosure of Japanese Patent Application No. 2019-231698 filed on Dec. 23, 2019 including the specification, drawings and abstract is incorporated herein by reference in its entirety.

BACKGROUND

1. Technical Field

The disclosure relates to a method for producing a salt core.

2. Description of Related Art

In metal casting such as die casting, a core having high strength is necessary for molding a hollow component. As a material of a core, granular sodium chloride (sometimes referred to as "salt") is suitably used. Japanese Patent Application Publication No. 07-195148 discloses a method for producing a salt core by pressure molding of granular salt as it is by using a hydraulic press (Claim 1, Paragraph 0002, Item of [Examples] and the like).

SUMMARY

In the above-described method in which granular salt as it is used as a molding material is subjected to pressure molding, coefficients of friction between salt crystals, and between a salt crystal and a die are so large that fluidity of the molding material is low in charging the molding material into the die, and hence, the molding material is difficult to charge into the die, and the degree of design freedom in shape of a core to be produced is low. When this method is employed, a core in a simple shape alone can be produced. Although there is a method in which salt is melted by heating to be charged into a die and then solidified, a large amount of energy is necessary for melting salt, and long time is necessary for solidifying the melted salt, and therefore, this method is costly, and has poor productivity.

The present disclosure provides a method for producing a salt core in which a salt core can be produced with low energy, low cost, and high productivity, and in which the salt core can be easily molded and the degree of design freedom in shape of the salt core is high.

A method for producing a salt core according to one aspect of the present disclosure includes a step (A) of adding a saturated sodium chloride aqueous solution to a sodium chloride crystal that is granular, to prepare a slurry mixed material of sodium chloride and water; a step (B) of subjecting the slurry mixed material to pressure molding to obtain a molded article; and a step (C) of drying the molded article to remove moisture.

In this aspect, a slurry mixed material of sodium chloride and water is obtained by adding a saturated sodium chloride aqueous solution (sometimes referred to as "saturated salt water") to a granular sodium chloride crystal (sometimes referred to as the "salt crystal"). When water is added to a granular salt crystal, a part of the granular salt crystal is eluted into water, which may change an average grain size of the salt crystal, and may change suitable molding conditions, and hence it is apprehended that molding cannot be stably performed. When saturated salt water is added to a granular salt crystal, elution of a part of the granular salt crystal into water is restrained, and change of the suitable molding conditions otherwise caused by change of the average grain size of the salt crystal can be restrained, and therefore, molding can be stably performed.

Besides, as a molding material, the slurry mixed material of sodium chloride and water is used. A large part of a liquid content contained in the molding material is squeezed out through the pressure molding, but the resultant molded article contains a remaining portion of the salt water. In the step (C) of removing moisture by drying the molded article, the salt is recrystallized, and hence a core having a high density close to a single crystal can be produced.

Besides, the saturated salt water is added to the salt crystal in an amount for covering the whole surface of each granular salt crystal with a film containing salt and water (sometimes referred to as the "hydrous film"). Since the salt crystals are not in direct contact with one another but the hydrous film is disposed among these, a coefficient of friction among the salt crystals is reduced, fluidity of the molding material is increased, and hence the molding material can be easily charged into a die. Similarly, since each salt crystal and a die are not in direct contact with each other but the hydrous film is disposed therebetween, a coefficient of friction between the salt crystal and the die is reduced, and hence the molding material can be easily charged into the die.

In this aspect, in a graph corresponding to the relationship between a mass of the saturated sodium chloride aqueous solution added with respect to 100 parts by mass of the sodium chloride crystal and a flow rate of a mixed material of sodium chloride and water, when a mass added with which the flow rate starts to increase, found by increasing the mass added from 0 parts by mass, is defined as Ma parts by mass, the mass added may be over Ma parts by mass in the step A.

With the above configuration, when the mass of the saturated salt water added is over Ma parts by mass, the mixed material to be used as the molding material is in the form of a slurry having fluidity, and hence the molding material can be easily charged into a die. When the mass of the saturated salt water added is over Ma parts by mass, the resultant mixed material is a slurry in which the whole surface of each salt crystal is covered with a hydrous film, and hence, the hydrous film is disposed among salt crystals and between a salt crystal and a die, and therefore, coefficients of friction among the salt crystals and between the salt crystal and the die are reduced, and the molding material can be easily charged into the die. When the method for producing a salt core of the present disclosure is employed, since the molding material can be easily charged into the die, the degree of design freedom in shape is preferably high. Differently from a method in which salt is melted by heating to be charged into a die, and then solidified, the method for producing a salt core of the present disclosure does not require melting and solidifying steps, and therefore, a salt core can be produced with low energy, low cost and high productivity.

In this aspect, in the graph, when a mass added with which the flow rate first reaches a maximum rate, found by increasing the mass added from 0 parts by mass, is defined as Mb parts by mass, the mass of the saturated sodium chloride aqueous solution added may be equal to or larger than Mb parts by mass in the step (A).

With the above configuration, when the mass of the saturated salt water added is in a range of the Ma to Mb parts by mass, it is apprehended that the flow rate varies even if the mass of the saturated salt water added is fixed, but when the mass of the saturated salt water added is equal to or larger than Mb parts by mass, the flow rate of the resultant mixed material is stabilized, and hence molding conditions are preferably stabilized. When the mass of the saturated salt water added is equal to or larger than Mb parts by mass, the whole surface of each salt crystal is covered with the hydrous film having a suitable thickness, and the flow rate of the resultant mixed material is preferably stabilized at the maximum rate.

In this aspect, the pressure molding may be performed with a liquid content of the slurry mixed material discharged from both sides in a pressure applying direction in the step (B). With the above configuration, the pressure molding can be performed with a concentration difference of the liquid content inhibited from occurring in the material contained in the die. When this method is employed, partial increase of the coefficient of friction among the salt crystals and the coefficient of friction between the salt crystal and the die caused due to remarkable partial lowering of the concentration of the liquid content can be restrained, and therefore, the pressure can be satisfactorily applied to the whole material through the whole step of the pressure molding, and hence, the pressure molding can be satisfactorily performed.

In this aspect, a lubricant that is oily, may be applied onto an inner surface of a die and then the slurry mixed material may be charged into the die to perform the pressure molding in the step (B). With the above configuration, the friction between the salt crystal and the die can be reduced by precedently applying an oily lubricant onto the inner surface of the die, and hence pressure can be satisfactorily applied to the whole molding material. It is noted that an aqueous lubricant cannot attain the lubricating effect because the lubricant is dissolved into water contained in the molding material.

In this aspect, the lubricant may have a dynamic viscosity of 20 to 120 mPa·s.

In this aspect, a die may be provided with one or more discharge holes, and the liquid content may be discharged through the discharge holes.

According to the aspect of the present disclosure, a salt core can be produced with low energy, low cost and high productivity, and thus, a method for producing a salt core in which the salt core can be easily molded, and the degree of design freedom in shape of the salt core is high can be provided.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

Method for Producing Salt Core

Figure 1:
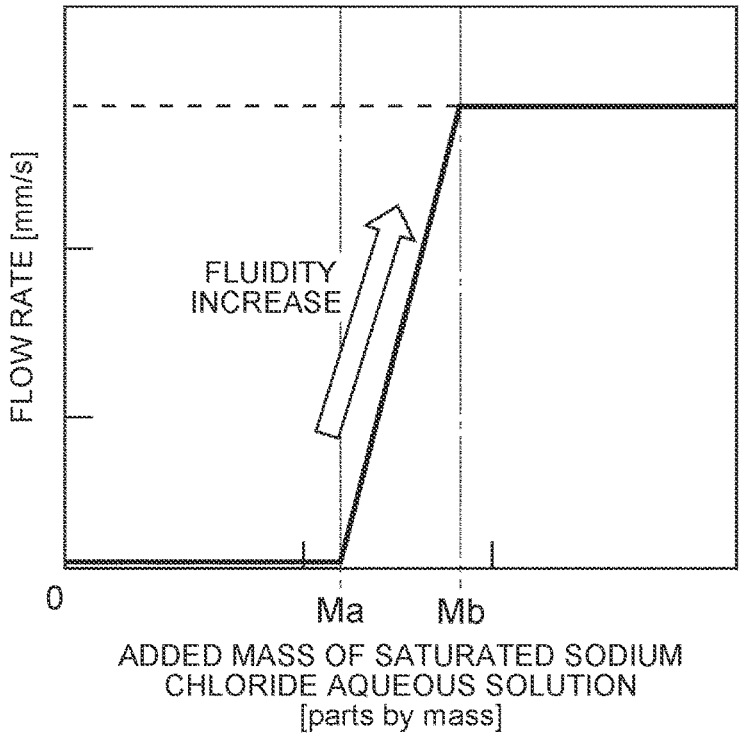
FIG. 1 is a conceptual diagram of a graph flatting the relationship between a mass of saturated salt water added and a flow rate of a mixed material.

A method for producing a salt core of the present disclosure includes a step (A) of adding a saturated sodium chloride aqueous solution (sometimes referred to as the "saturated salt water") to a granular sodium chloride crystal (sometimes referred to as the "salt crystal") to prepare a slurry mixed material of sodium chloride and water, a step (B) of subjecting the slurry mixed material to pressure molding, and a step (C) of drying the molded article to remove moisture.

Step (A)

In the method for producing a salt core of the present disclosure, a slurry mixed material of sodium chloride and water is obtained by adding a saturated sodium chloride aqueous solution (saturated salt water) to a granular sodium chloride crystal (salt crystal). When water is added to a granular salt crystal, a part of the granular salt crystal is eluted into water, which may change an average grain size of the salt crystal, and may change suitable molding conditions, and hence it is apprehended that molding cannot be stably performed. When saturated salt water is added to a granular salt crystal, elution of a part of the granular salt crystal into water is restrained, and change of the suitable molding conditions otherwise caused by change of the average grain size of the salt crystal can be restrained, and therefore, molding can be stably performed.

In the method for producing a salt core of the present disclosure, the slurry mixed material of sodium chloride (sometimes referred to as the "salt") and water is used as a molding material. A large part of a liquid content contained in the molding material (for example, about 90% of the whole molding material) is squeezed out by the pressure molding, but a remaining portion of the salt water is contained in the resultant molded article. In the step (C) of removing moisture by drying the molded article, the salt is recrystallized, and thus, a core having a high density close to a single crystal can be produced.

In the method for producing a salt core of the present disclosure, the saturated salt water is added to the salt crystal in an amount for covering the whole surface of each granular salt crystal with a film containing salt and water (sometimes referred to as the "hydrous film"). Since salt crystals are not in direct contact with one another but the hydrous film is disposed among these, a coefficient of friction among the salt crystals is reduced, the fluidity of the molding material is increased, and hence the molding material can be easily charged into a die. Similarly, since a salt crystal and a die are not in direct contact with each other but the hydrous film is disposed therebetween, a coefficient of friction between the salt crystal and the die is reduced, and hence the molding material can be easily charged into the die.

Method for Preparing Saturated Salt Water

The saturated salt water can be prepared, for example, by the following method. An environmental temperature at the time of preparing the saturated salt water is measured, solubility at the measured environmental temperature is obtained based on a solubility curve of sodium chloride, and sodium chloride in a rather larger amount than that corresponding to the solubility is added to water, and the resultant is mixed by stirring. A supernatant excluding salt remained unmelted on the bottom is used as the saturated salt water. For example, at room temperature of about 20 to 25° C., a salt concentration of saturated salt water is about 28% by mass.

It is assumed that a mass of the saturated salt water added with respect to 100 parts by mass of the granular salt crystal (hereinafter simply referred to as the "mass of the saturated salt water added" or "mass added") is M [parts by mass]. With the mass of the saturated salt water added changed, the saturated salt water is added to the salt crystal and the resultant is mixed by stirring to prepare a plurality of types of mixed materials different in the mass of the saturated salt water added, and a flow rate of each of these mixed materials is measured. The unit of the flow rate is, for example, "mm/s". The flow rate can be measured by a measurement method 1 or a measurement method 2 described below, and the measurement method 1 is preferred.

Measurement Method 1 for Flow Rate

Figure 8:
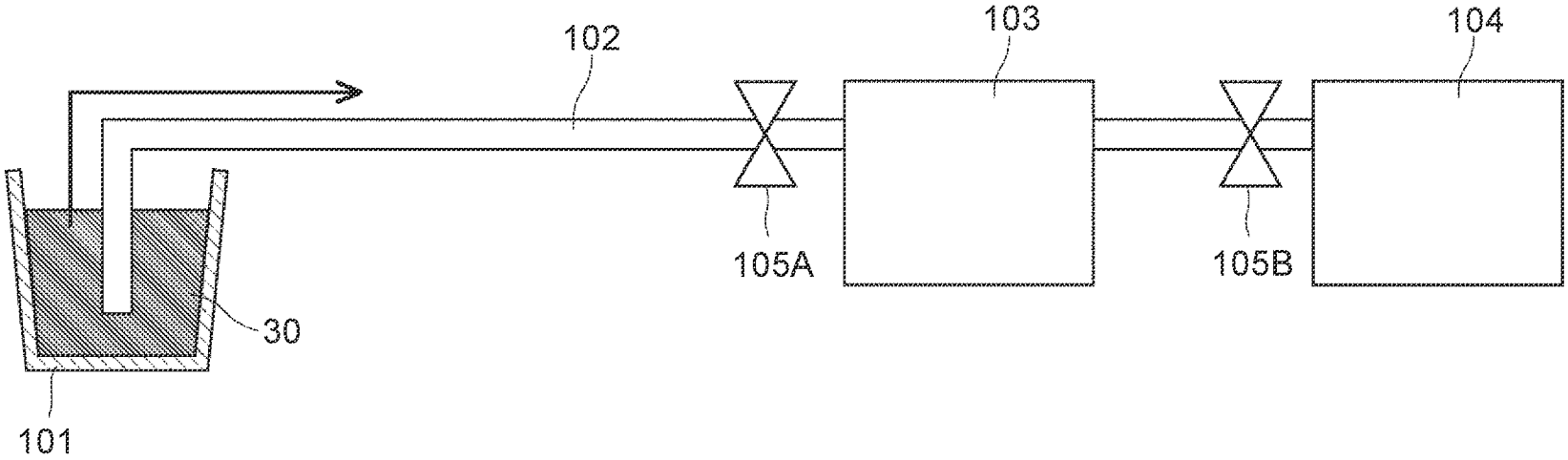
FIG. 8 is an explanatory diagram of a measurement method 1 for a flow rate.

As illustrated in FIG. 8, 80 mL of a mixed material 30 obtained by adding and mixing saturated salt water to and with a salt crystal is put in a beaker 101 having a capacity of 100 mL. A first end of a nylon tube 102 having an outer diameter of 6 mmϕ and an inner diameter of 4 mmϕ is inserted into the mixed material 30 contained in the beaker 101 to a depth of about 30 mm from the surface of the mixed material 30. A second end of the tube 102 is drawn out of the beaker 101 and connected to a vacuum vessel 103 having a capacity of 15 L. The vacuum vessel 103 is connected to a vacuum pump 104. In the middle of the tube 102 connecting between the mixed material 30 contained in the beaker 101 and the vacuum vessel 103, a first valve 105A is disposed, and a second valve 105B is disposed between the vacuum vessel 103 and the vacuum pump 104. With the first valve 105A closed, the second valve 105B is opened to reduce the pressure within the vacuum vessel 103 down to 99 kPa or less, and then, the second valve 105B is closed and the first valve 105A is opened to vacuum-suck the mixed material 30 contained in the beaker 101. With a vacuum suction time set to 1 second, a length of the mixed material 30 sucked into the tube 102 (suction length) [mm] is obtained to obtain a flow rate [mm/s]. This evaluation is performed three times in total, and an average value and data variation are obtained.

Measurement Method 2 for Flow Rate

A resin plate (200 mm×450 mm, thickness of 5 mm) is disposed to be inclined with respect to the ground by 35°. At this point, the resin plate is disposed such that a principal surface (a surface having a larger area) of the resin plate can face the ground, and that a lengthwise direction of the principal surface can be inclined with respect to the ground. On an upper portion of the surface of the resin plate, 7.5 mL of a mixed material obtained by adding and mixing saturated salt water to and with a salt crystal is placed quietly with a ladle or the like. A time for the mixed material to flow down on the surface of the resin plate by a length of 50 mm is measured to obtain a flow rate. This evaluation is performed three times in total, and an average value and data variation are obtained.

In the measurement method 1 for the flow rate, the type and the capacity of the vessel for containing the mixed material 30, the material and the diameter of the tube connecting the mixed material 30 contained in the vessel and the vacuum vessel 103, the capacity of the vacuum vessel 103, the number of times of performing the evaluation for obtaining an average, the suction time and the like can be appropriately changed. In the measurement method 2 for the flow rate, the type, the size and the inclination angle of the resin plate, the flowing length of the mixed material to be measured for the time of the mixed material flowing, the number of times of performing the evaluation for obtaining an average and the like can be appropriately changed. It is noted, however, that the experiment is performed plural times under the same evaluation conditions but with the mass of the saturated salt water added changed to create a graph described below.

The graph is created by using, as a parameter on the abscissa, the mass M [parts by mass] of saturated salt water added with respect to 100 parts by mass of the granular salt crystal, and using, as a parameter on the ordinate, a flow rate [mm/s] of a mixed material obtained by adding and mixing M parts by mass of the saturated salt water added to and with 100 parts by mass of the salt crystal.

FIG. 1 is a conceptual diagram of a graph plotting the relationship between the mass of the saturated salt water added with respect to 100 parts by mass of the granular salt crystal and the flow rate of the mixed material. As illustrated in FIG. 1, when the mass of the saturated salt water added is increased from 0 part by mass, at first the flow rate is zero or close to zero, and the mixed material does not exhibit fluidity. When the mass of the saturated salt water added reaches Ma parts by mass, the flow rate starts to increase. Thereafter, the flow rate tends to increase in accordance with the increase of the mass of the saturated salt water added, the flow rate reaches a maximum rate when the mass of the saturated slat water added reaches Mb parts by mass, and thereafter, even if the mass of the saturated salt water added is further increased, the flow rate minimally changes. In other words, Ma corresponds to the mass of the saturated salt water added with which the flow rate starts to increase. Mb corresponds to the mass of the saturated salt water added with which the flow rate reaches the maximum rate for the first time.

The following experiment was performed as Example 1. A commercially available salt crystal (manufactured by NM Salt Corporation) having a grain size distribution of 150 to 250 μm, an average grain size of 200 μm and a purity of 95% or more was prepared to prepare saturated salt water by the above-described preparation method. The saturated salt water was added to the salt crystal, and the resultant was mixed by stirring to obtain a mixed material. Mixed materials were obtained with the mass of the saturated salt water added with respect to 100 parts by mass of the salt crystal changed in a range of 15 to 35 parts by mass, and the thus obtained mixed materials were measured for a flow rate [mm/s] by the above-described measurement method 1. The experiment was performed at room temperature of 20 to 25° C., and a concentration of the saturated salt water at this point was about 28% by mass.

Figure 2:
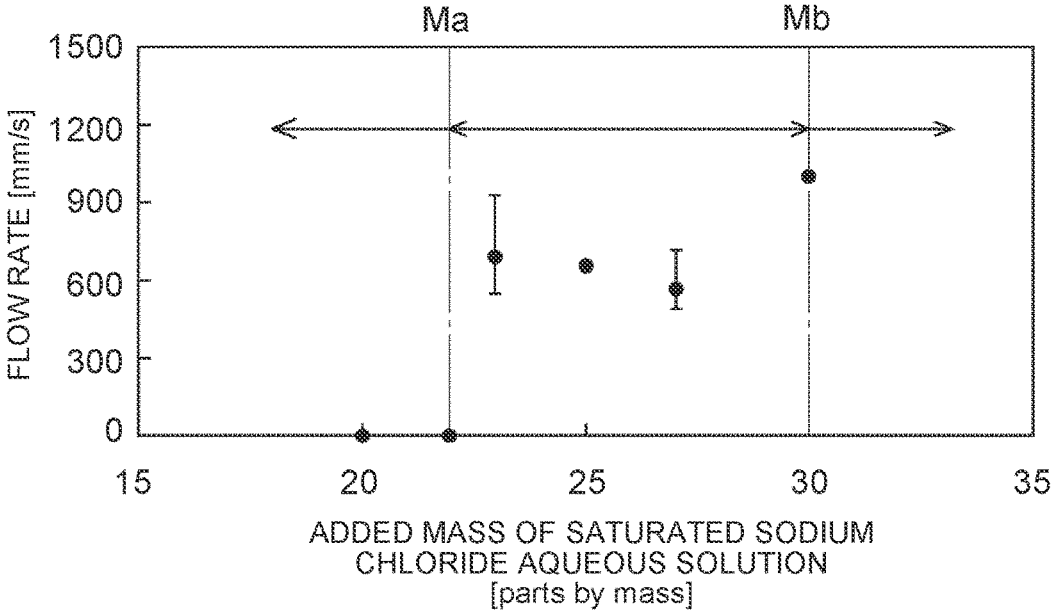
FIG. 2 is a graph illustrating the relationship between a mass of saturated salt water added and a flow rate of a mixed material obtained in Example 1.

A graph (actually measured data) corresponding to the relationship between the mass of the saturated salt water added with respect to 100 parts by mass of the granular salt crystal and the flow rate of the mixed material obtained in Example 1 is illustrated in FIG. 2. When the mass of the saturated salt water added was increased from 0 parts by mass, at first the flow rate was zero or close to zero, and the mixed material did not exhibit fluidity. When the mass of the saturated salt water added reached 22 parts by mass, the flow rate started to increase. Thereafter, although there was variation, the flow rate tended to increase as the mass of the saturated salt water added increased. When the mass of the saturated salt water added reached 30 parts by mass, the flow rate reached the maximum rate, and the flow rate was minimally changed even if the mass of the saturated salt water added was further increased. In Example 1, the mass Ma of the saturated salt water added when the flow rate starts to increase was 22 parts by mass, and the mass Mb of the saturated salt water added when the flow rate reaches the maximum rate first was 30 parts by mass.

Figure 3A:
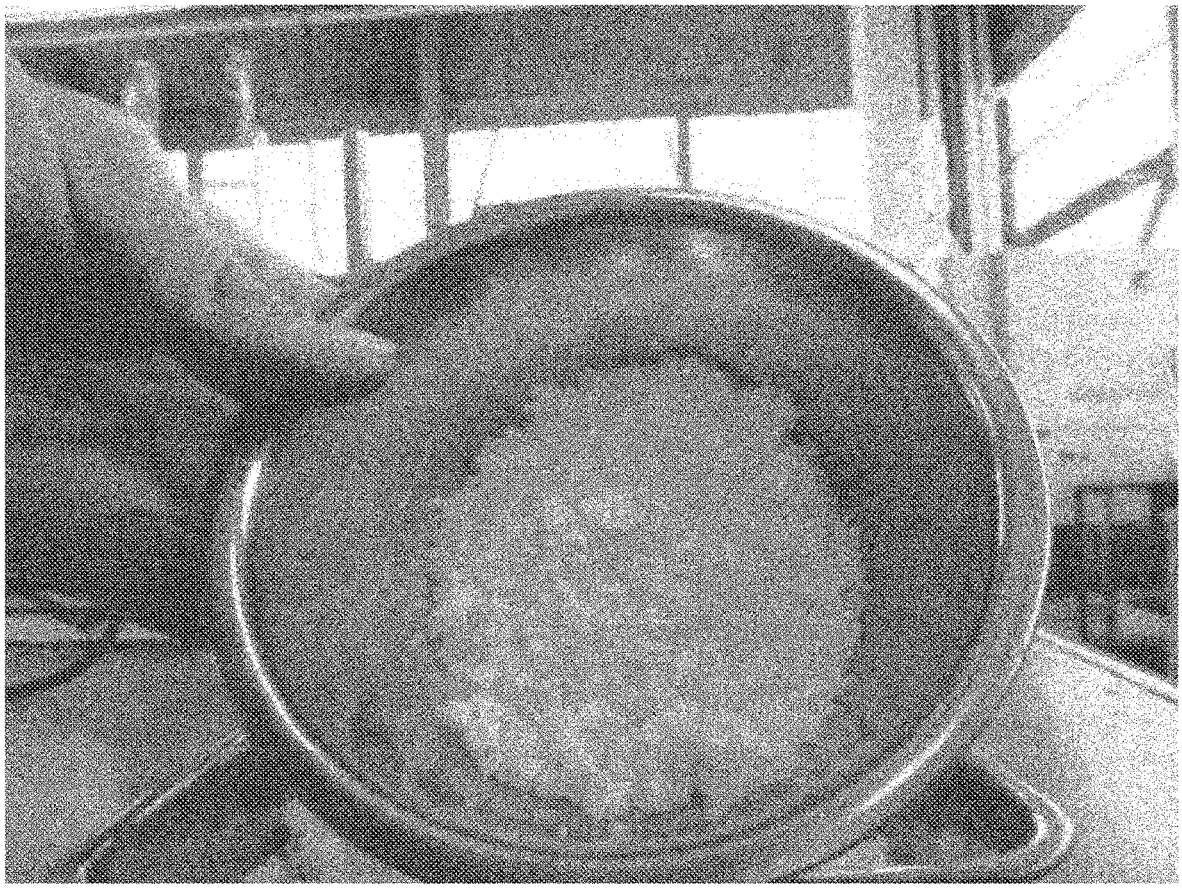
FIG. 3A is an example of a photograph of the appearance of a mixed material obtained when the mass of saturated salt water added is 5 to 10 parts by mass in Example 1.
Figure 3B:
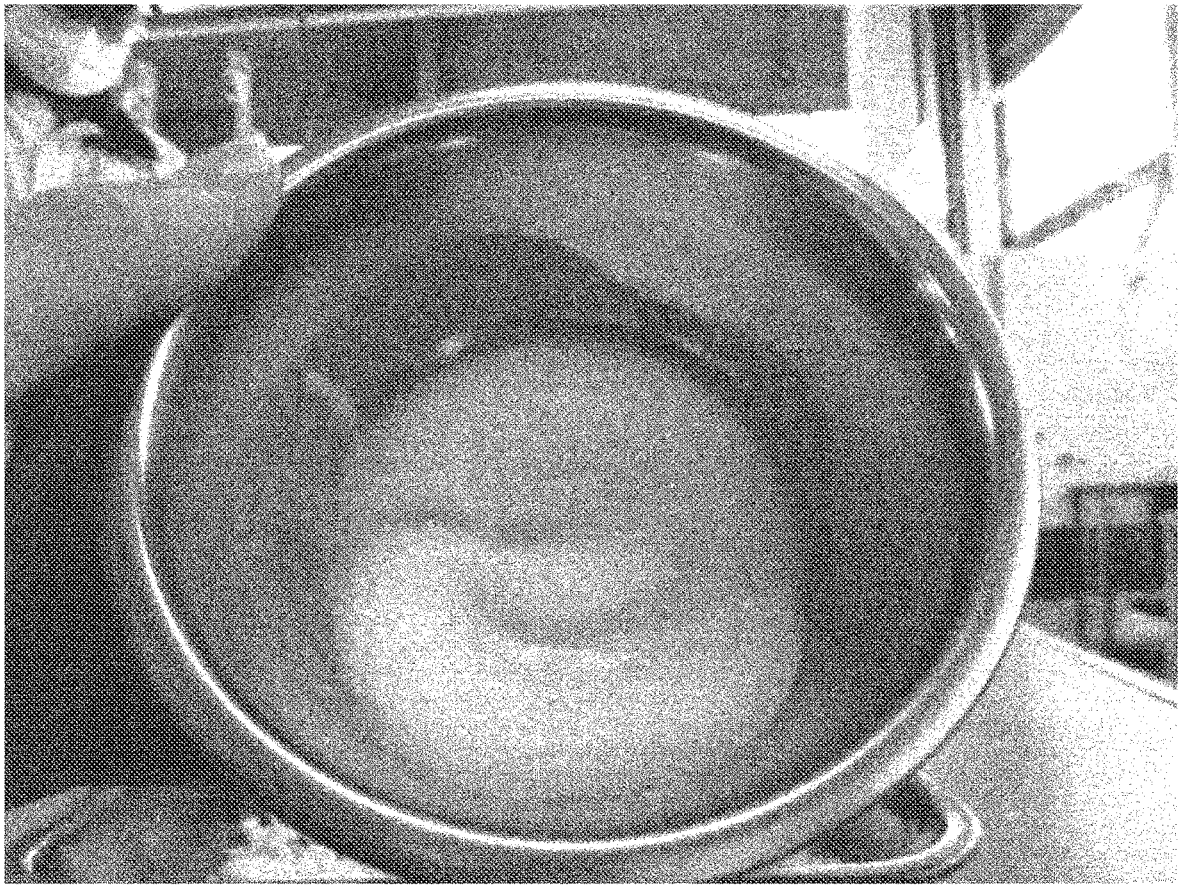
FIG. 3B is an example of a photograph of the appearance of a mixed material obtained when the mass of saturated salt water added is 22.5 parts by mass in Example 1.

FIG. 3A illustrates an example of a photograph of the appearance of a mixed material obtained when the mass of the saturated salt water added was 5 to 10 parts by mass (over 0 parts by mass and smaller than Ma parts by mass) in Example 1. FIG. 3B illustrates an example of a photograph of the appearance of a mixed material obtained when the mass of the saturated salt water added was 22.5 parts by mass (over Ma parts by mass and smaller than Mb parts by mass) in Example 1. As illustrated in FIG. 3A, when the mass of the saturated salt water added was in a range of over 0 parts by mass and smaller than t Ma parts by mass, the mixed material had a wet sand-like appearance, and minimally exhibited fluidity. As illustrated in FIG. 3B, when the mass of the saturated salt water added was in a range over t Ma parts by mass and smaller than Mb parts by mass, the mixed material had a sherbet-like slurry appearance, and exhibited fluidity.

Figure 4:
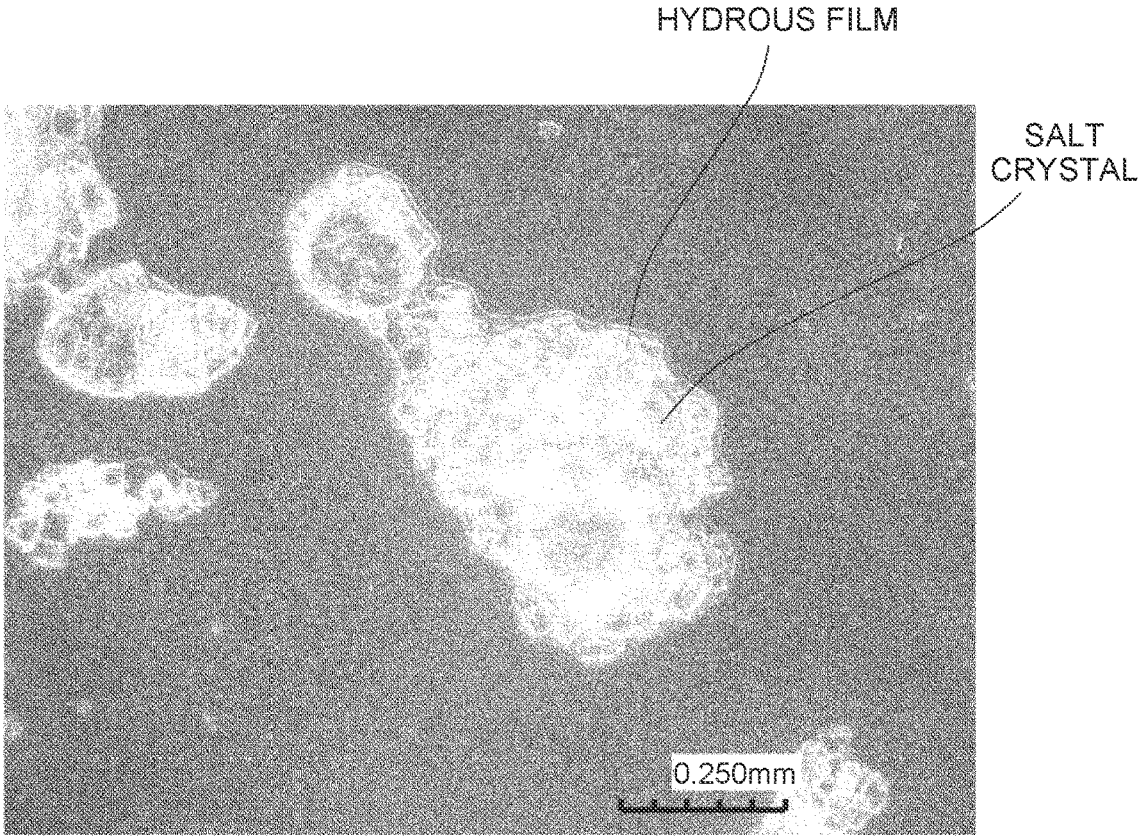
FIG. 4 is an example of a microphotograph of a mixed material (slurry) obtained when the mass of a saturated sodium chloride aqueous solution added is Mb parts by mass (specifically, 25 parts by mass) in Example 1.

A microphotograph of the mixed material (slurry) obtained when the mass of the saturated salt water added was 25 parts by mass in Example 1 is illustrated in FIG. 4. As illustrated in FIG. 4, a state where the whole surface of each salt crystal was covered with a hydrous film with a thickness of about 5 μm was observed.

The Ma parts by mass corresponding to the mass of the saturated salt water added with which the flow rate starts to increase corresponds to a minimum added amount of the saturated salt water for obtaining a state where the whole surface of each salt crystal is covered with a hydrous film. When the mass added is in a range of 0 to Ma parts by mass, the mixed material remains to be in a wet sand-like state and the flow rate is zero or close to zero even if the mass of the saturated salt water added is increased, and the mixed material does not exhibit fluidity. When the mass of the saturated salt water added is in a range of Ma to Mb parts by mass, there is a tendency that the thickness of the hydrous film covering the whole surface of each salt crystal and/or the amount of the saturated salt water present among the salt crystals is increased, and the flow rate increases as the added amount of the saturated water is increased. When the mass of the saturated salt water added is equal to or larger than Mb parts by mass, the effect is saturated, and the flow rate remains to be high and minimally changes even if the mass of the saturated salt water added is further increased.

A "slurry mixed material" refers to a material that has an appearance, as illustrated in FIG. 3B, including no large lump but small grains homogeneously dispersed, and is in a state, when enlarged with a microscope, where the whole surface of each granular salt crystal is covered with a hydrous film. The "slurry mixed material" is a material having a flow rate over zero measured by the above-described measurement method 1 or 2 for a flow rate, and preferably by the measurement method 1 for a flow rate.

The values of the masses Ma and Mb are changed in accordance with a grain size distribution and an average grain size of the salt crystal. As described above, the graph of FIG. 2 is an example of data obtained by using the salt crystal having a grain size distribution of 150 μm to 250 μm and an average grain size of 200 μm, and in this example, Ma is 22 parts by mass, and Mb is 30 parts by mass. Herein, a grain size distribution and an average grain size of a salt crystal are obtained by dry sieving in accordance with JIS G5901 (Molding silica sand) unless otherwise stated.

Figure 5:
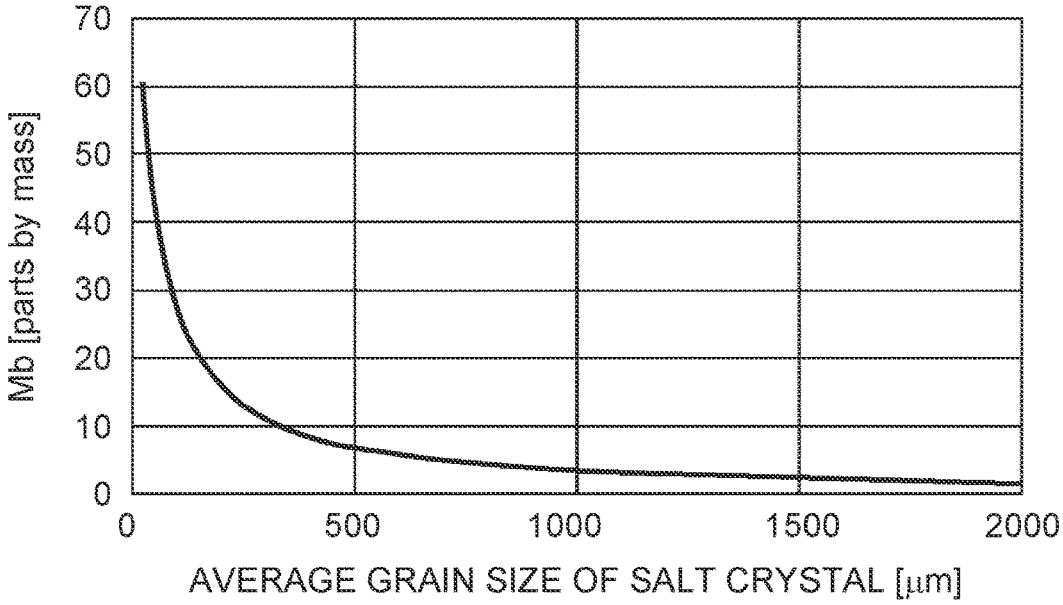
FIG. 5 is a graph illustrating the relationship between an average grain size D [μm] of a salt crystal and the mass Mb [parts by mass] of saturated salt water added.

An average surface area of a salt crystal can be obtained based on an average grain size D [μm] of the salt crystal. It is assumed that the thickness of the hydrous film is 5 μm. At this time, the volume of the hydrous film can be obtained as [average surface area of salt crystal]×5 μm. Based on the volume of the hydrous film and the density of the saturated salt water, the minimum mass Ma [parts by mass] of the saturated salt water added for covering the whole surface of a salt crystal having an average grain size D [μm] with a hydrous film having a thickness of 5 μm can be obtained. A graph flatting the thus theoretically obtained relationship between the average grain size D [μm] and the mass Ma [parts by mass] of the saturated salt water added is illustrated in FIG. 5. With respect to a salt crystal having an arbitrary average grain size, the minimum mass Ma [parts by mass] of the saturated salt water added for covering the whole surface of each salt crystal with the hydrous film having a thickness of 5 μm can be predicted based on FIG. 5. It is noted that the graph of FIG. 5 is predicted data for a case where the grain size distribution is narrow, and is merely reference data. Actually, the values of the masses Ma and Mb are changed in accordance with the grain size distribution of the salt crystal. Accordingly, it is necessary to obtain data as illustrated in FIG. 1 and FIG. 2 about a salt crystal to be actually used to obtain the values of the masses Ma and Mb.

In the step (A), the mass of the saturated salt water added with respect to 100 parts by mass of the salt crystal is preferably over Ma parts by mass. When the mass of the saturated salt water added is over Ma parts by mass, the resultant mixed material to be used as the molding material is in the form of a slurry having fluidity, and hence the molding material can be easily charged into a die. When the mass of the saturated salt water added is over Ma parts by mass, the resultant mixed material is a slurry in which the whole surface of each salt crystal is covered with a hydrous film, and hence, the hydrous film is disposed among salt crystals and between a salt crystal and a die, and therefore, coefficients of friction among the salt crystals and between the salt crystal and the die are reduced, and the molding material can be easily charged into the die. When the method for producing a salt core of the present disclosure is employed, since the molding material can be thus easily charged into a die, the degree of design freedom in shape is preferably high. Differently from a method in which salt is melted by heating to be charged into a die, and then solidified, the method for producing a salt core of the present disclosure does not require melting and solidifying steps, and hence, a salt core can be produced with low energy, low cost and high productivity.

When the mass of the saturated salt water added is over Ma parts by mass and equal to or smaller than Mb parts by mass, the flow rate of the resultant mixed material tends to increase as the mass of the saturated salt water added increases. Under this condition, there is a tendency that as the mass of the saturated salt water added increases, the thickness of the hydrous film covering the whole surface of each salt crystal and/or the amount of the saturated salt water present among the salt crystals increases, and the flow rate increases. When the mass of the saturated salt water added reaches Mb parts by mass, the flow rate reaches the maximum rate, and the flow rate does not increase even if the mass added is further increased.

It is more preferable that the mass of the saturated salt water added is equal to or larger than Mb parts by mass in the step (A). When the mass of the saturated salt water added is Ma to Mb parts by mass, it is apprehended that the flow rate varies even if the mass of the saturated salt water added is fixed, and the mass of the saturated salt water added is preferably equal to or larger than Mb parts by mass because the flow rate of the resultant mixed material is thus stabilized, and hence molding conditions are stabilized. The mass of the saturated salt water added is preferably equal to or larger than Mb parts by mass because the whole surface of each salt crystal is thus covered with the hydrous film having a suitable thickness (for example, a thickness of 5 μm or more), and the flow rate of the resultant mixed material is stabilized at the maximum rate. Since the flow rate of the mixed material is stabilized at the maximum rate, the mixed material is easily charged into a die, the degree of design freedom in shape of the salt core is high, the molding conditions are stabilized, and deterioration of peripheral equipment can be restrained, the mass of the saturated salt water added is particularly preferably in a range of Mb to Mb+10 (30 to 40 parts by mass in Example 1).

Step (B)

In the step (B), the slurry mixed material is subjected to the pressure molding to obtain a molded article. Specifically, the slurry mixed material obtained in the step (A) is charged into a die, pressure is externally applied to the die, and the thus obtained molded article is taken out of the die. The pressure molding can be performed by a known method.

The die is not especially limited, and is preferably a die including a combination of a first die and a second die. For example, a die including a combination of an upper die and a lower die is used, the slurry mixed material is charged into the lower die, and the lower die containing the slurry mixed material therein is combined with the upper die, pressure is applied from above to the upper die with the lower die fixed. In this case, pressure is applied to the molding material from above and below, and thus, the pressure molding can be performed. A pressure force is not especially limited, and is preferably about 400 MPa.

In this step, a large part of a liquid content contained in the molding material (for example, about 90% of the whole molding material) is squeezed out by pressure application. At least the lower die out of the upper die and the lower die is provided, on a bottom or the like, with one or more discharge holes for discharging the liquid content.

In the case where the discharge hole is provided in the lower die alone, when a pressure is applied to the upper die from above, the liquid content moves from an upper portion to a lower portion in the material contained in the die, and the liquid content is discharged through the discharge hole of the lower die. In this case, the concentration of the liquid content is remarkably lowered in the upper portion of the material contained in the die, the coefficient of friction among the salt crystals and the coefficient of friction between the salt crystal and the die are increased, which makes it difficult to apply pressure to the upper die from above, and hence the pressure force cannot sufficiently reach the lower portion, and hence molding failure may be caused.

Therefore, one or more discharge holes for discharging the liquid content are preferably provided in both the lower die and the upper die. Thus, the liquid content can be discharged, in the pressure molding, upward and downward (to both sides in the pressure applying direction), and the pressure molding can be performed with restraining a concentration difference of the liquid content caused between the upper and lower portions in the material contained in the die. When this method is employed, remarkable lowering of the concentration of the liquid content otherwise caused in the upper portion of the material contained in the die can be restrained, and increase of the coefficient of friction among the salt crystals and the coefficient of friction between the salt crystal and the die can be restrained. Therefore, the pressure can be satisfactorily applied to the upper die from above through the whole step of the pressure molding, the pressure force sufficiently also reaches the lower portion, and hence, the pressure molding can be satisfactorily performed as a whole.

In other words, in the step (B), the pressure molding is preferably performed with the liquid content of the slurry mixed material discharged from the both sides in the pressure applying direction. When this method is employed, the pressure molding can be performed with restraining a concentration difference of the liquid content in the material contained in the die. When this method is employed, partial increase of the coefficient of friction among the salt crystals and the coefficient of friction between the salt crystal and the die caused due to remarkable partial lowering of the concentration of the liquid content can be restrained, and therefore, the pressure can be satisfactorily applied to the whole material through the whole step of the pressure molding, and hence, the pressure molding can be satisfactorily performed as a whole.

Figure 6:
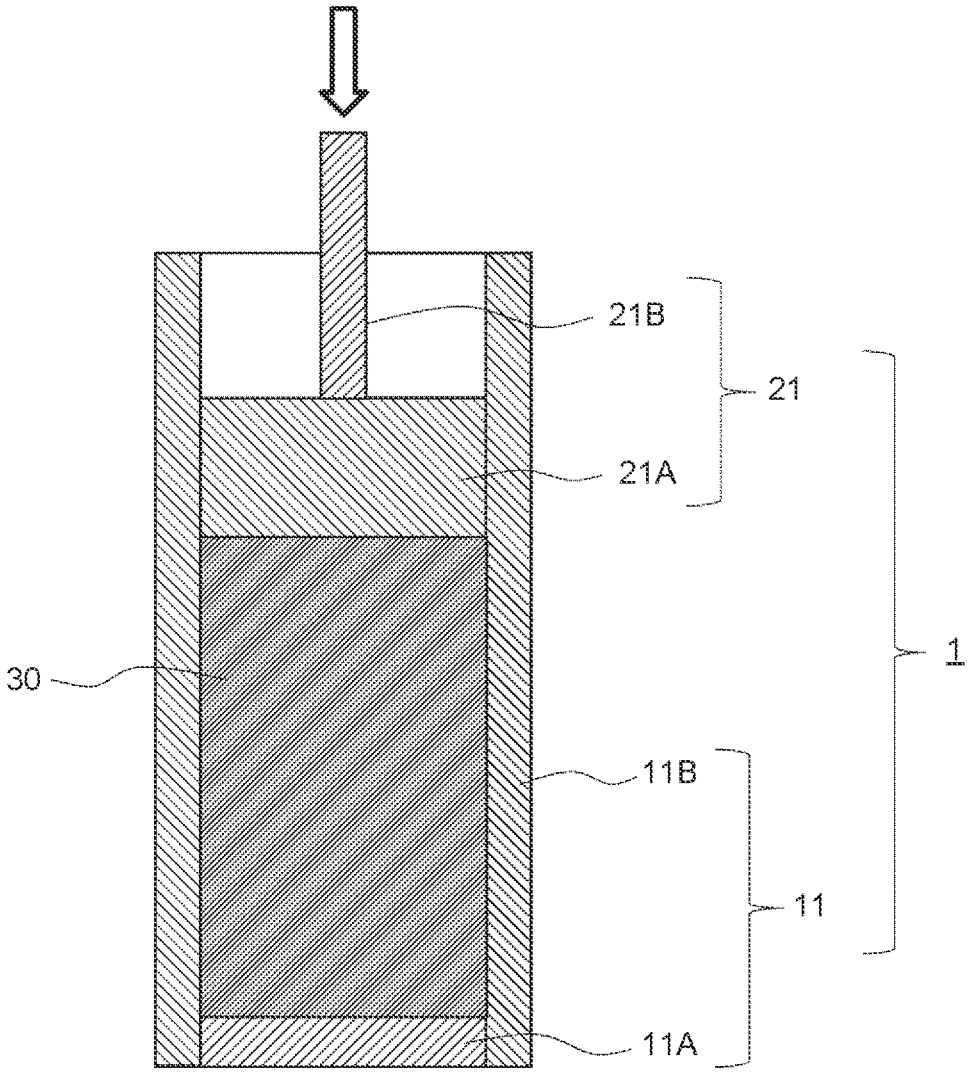
FIG. 6 is a schematic cross-sectional view illustrating an example of a die to be used for molding a cylindrical salt core, and a pressure molding method using the same.

FIG. 6 is a schematic cross-sectional view illustrating an example of a die to be used for molding a cylindrical salt core, and a pressure molding method using the same. In this drawing, a reference sign 1 denotes a die consisting of a lower die and an upper die. A reference sign 11 denotes the lower die, a reference sign 11A denotes a bottom of the lower die, and a reference sign 11B denotes a side portion of the lower die. The side portion 11B of the lower die is a cylindrical member, and the bottom 11A of the lower die is a disc-shaped member covering a lower opening of the cylindrical side portion 11B. A reference sign 21 denotes the upper die, and includes a disc-shaped pressing member 21A having an outer diameter equivalent to the inner diameter of the side portion 11B of the lower die, and a bar-shaped member 21B formed on an outer surface of the pressing member to extend in a direction of the central axis thereof. A reference sign 30 denotes a molding material (slurry mixed material) charged into a molding space within the lower die 11. One or more discharge holes (not shown) are formed in each of the bottom 11A of the lower die and the pressing member 21A of the upper die. As illustrated with an arrow, the upper die 21 is pressed down in the downward direction in the drawing for the pressure molding of the molding material charged into the lower die 11. At this point, the liquid content squeezed out by the pressure application is discharged through the one or more discharge holes formed in each of the bottom 11A of the lower die and the pressing member 21A of the upper die.

The size of each discharge hole is preferably a minute size through which the liquid content can be discharged without causing a solid content of the molding material to largely flow out. A method for producing a disc-shaped member having one or more discharge holes is not especially limited. For example, a joint member obtained by jointing a plurality of separate members can be used as each of the bottom 11A of the lower die and the pressing member 21A of the upper die. In the joint member, a minute gap of about 0.02 mm is provided among the plural separate members, so that this minute gap can work as the discharge hole.

As Example 2, the die as illustrated in FIG. 6 was prepared to perform the pressure molding. The molding space of the lower die had a diameter of 15 mm and a length of 300 mm. The outer diameter of the pressing member of the upper die was set to a size capable of entering the molding space of the lower die substantially without a gap and capable of vertically smoothly moving. As the bottom 11A of the lower die, a disc-shaped joint member obtained by jointing two semi-disc-shaped separate members and having a minute gap of about 0.02 mm between the two separate members was used, and as the pressing member 21A of the upper die, a disc-shaped joint member obtained by jointing two semi-disc-shaped separate members and having a minute gap of about 0.02 mm between the two separate members was used. A slurry mixed material 30, which was prepared by adding and mixing 23 parts by mass of saturated salt water to and with 100 parts by mass of a salt crystal, was charged into the molding space of the lower die 11, and then the upper die 21 was set. Under this condition, a pressure of 400 MPa was applied from above to the upper die 21 to press the molding material. A liquid content was discharged through both the bottom 11A of the lower die and the pressing member 21A of the upper die, and the molding material was satisfactorily pressure molded as a whole, resulting in obtaining a molded product having a height of about 60 mm.

Figure 7A:
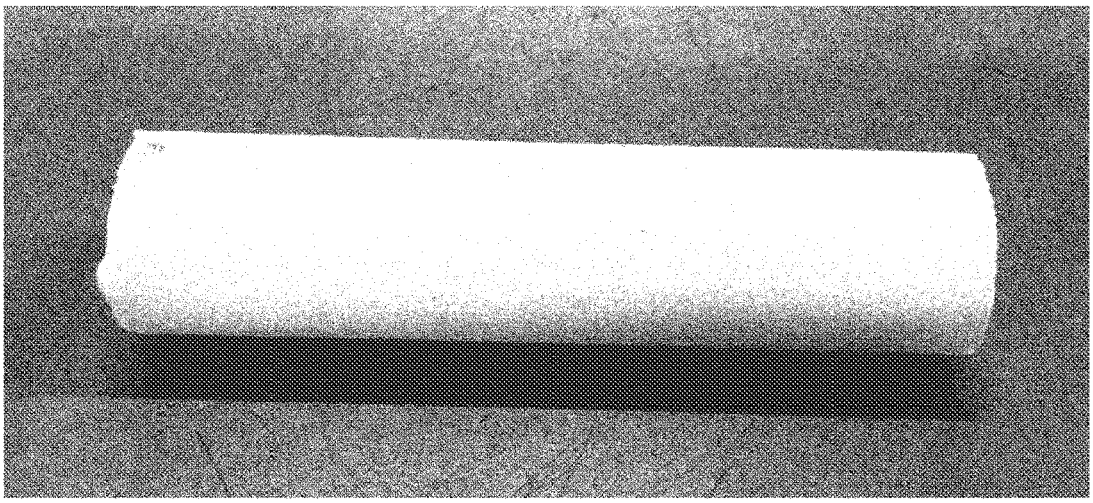
FIG. 7A is an example of a photograph of a cylindrical salt core obtained in Example 2.
Figure 7B:
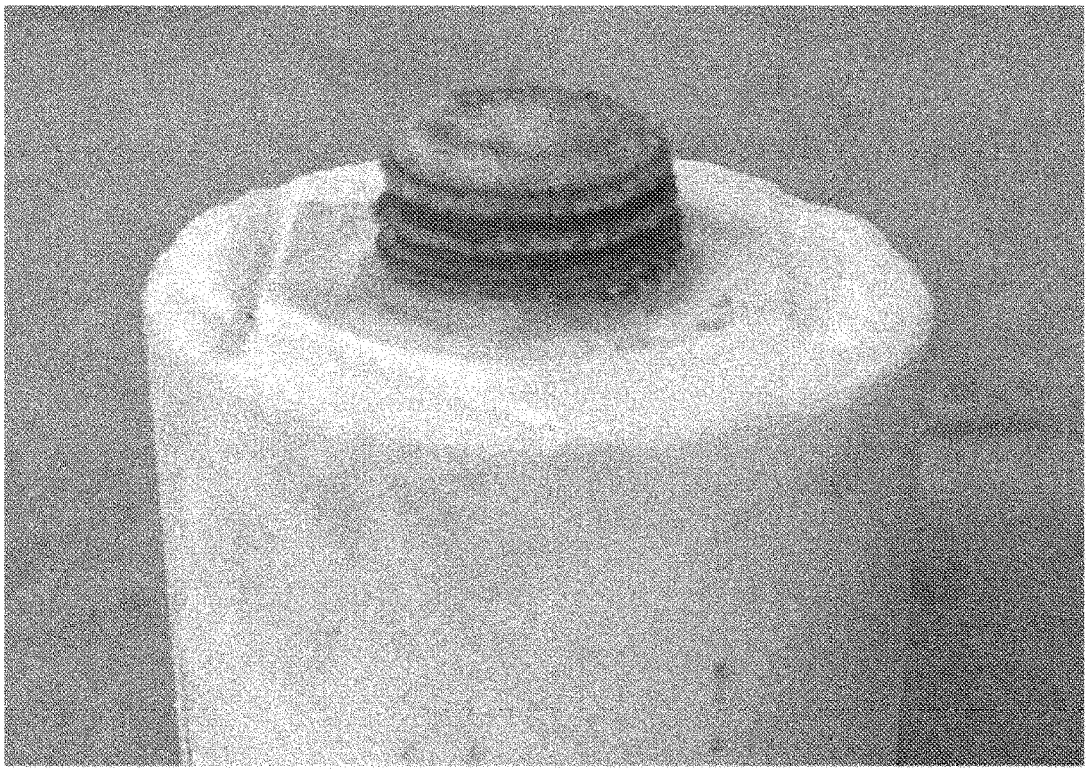
FIG. 7B is an example of a photograph of a cylindrical salt core with a male screw obtained by a method similar to that of Example 2.
Figure 7C:
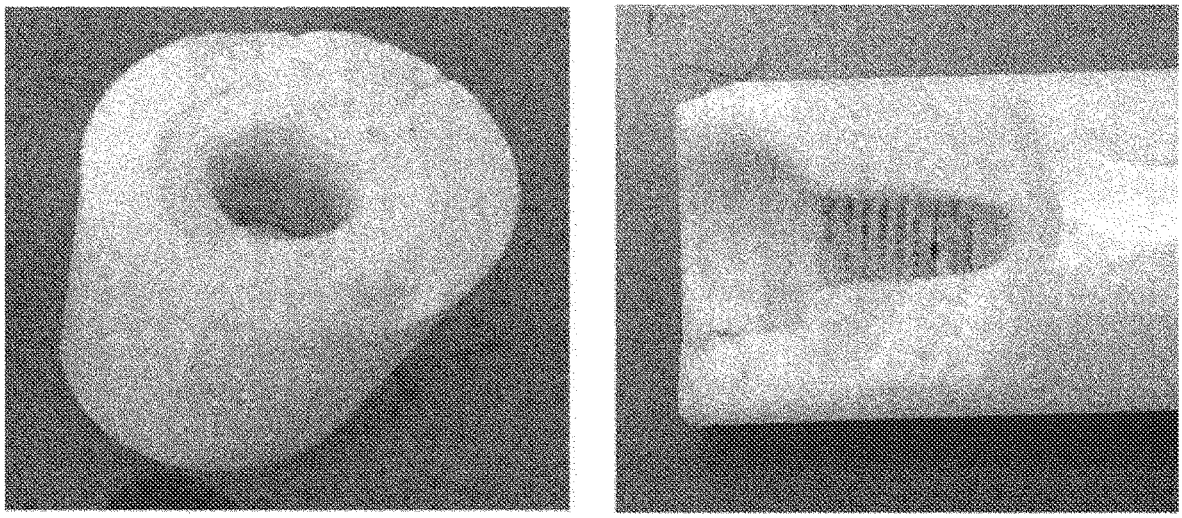
FIG. 7C is an example of photographs of a cylindrical salt core with a female screw obtained by a method similar to that of Example 2.

FIG. 7A is an example of a photograph of a cylindrical salt core obtained in Example 2. FIG. 7B is an example of a photograph of a cylindrical salt core with a male screw obtained in the same manner as in Example 2 except that the shape of the die was changed. FIG. 7C is an example of photographs of a cylindrical salt core with a female screw obtained in the same manner as in Example 2 except that the shape of the die was changed. In FIG. 7C, a left portion is a photograph of the whole of the cylindrical salt core with a female screw, and a right portion is a photograph of the salt core processed such that the inside can be easily seen. As illustrated in FIGS. 7A to 7C, the method of the present disclosure was revealed to be a method in which the degree of design freedom in shape of a salt core is high and a salt core in a desired shape can be satisfactorily molded.

When pressure is applied to the molding material in a direction from a first end of the molding material to a second end thereof, particularly when a distance from the first end to the second end of the molding material is large, the pressure force is gradually reduced from the first end to the second end of the molding material due to contact resistance among salt crystals and resistance caused by friction between the salt crystal and the die, and hence, the pressure cannot be sufficiently applied to a portion on the second end side, and it is apprehended that a density of a resultant molded product may be reduced. When the pressure force is increased, equipment cost is increased, and it is apprehended that damage applied to the die may be increased.

In the step (B), it is preferable that the pressure molding is performed with the slurry mixed material corresponding to the molding material charged into the die after applying an oily lubricant onto the inner surface of the die. When an oily lubricant is precedently applied onto the inner surface of the die, friction between the salt crystal and the die can be reduced such that pressure can be satisfactorily applied to the whole molding material. When this method is employed, the pressure application can be smoothly performed without increasing the pressure force owing to improved efficiency of the pressure application. When this method is employed, differently from a case where the pressure force is increased, the equipment cost is not increased, and damage applied to the die is not increased. It is noted that an aqueous lubricant cannot attain the lubricating effect because the lubricant is dissolved into water contained in the molding material. In the following description, the lubricant is an "oily lubricant" unless otherwise stated.

When an oily component enters between salt crystals, adhesion between the salt crystals is degraded, and it is apprehended that the density of a resultant molded product may be reduced. Therefore, the lubricant preferably has a viscosity at a level where the lubricant applied onto the inner surface of the die does not enter between salt crystals.

Figure 9:
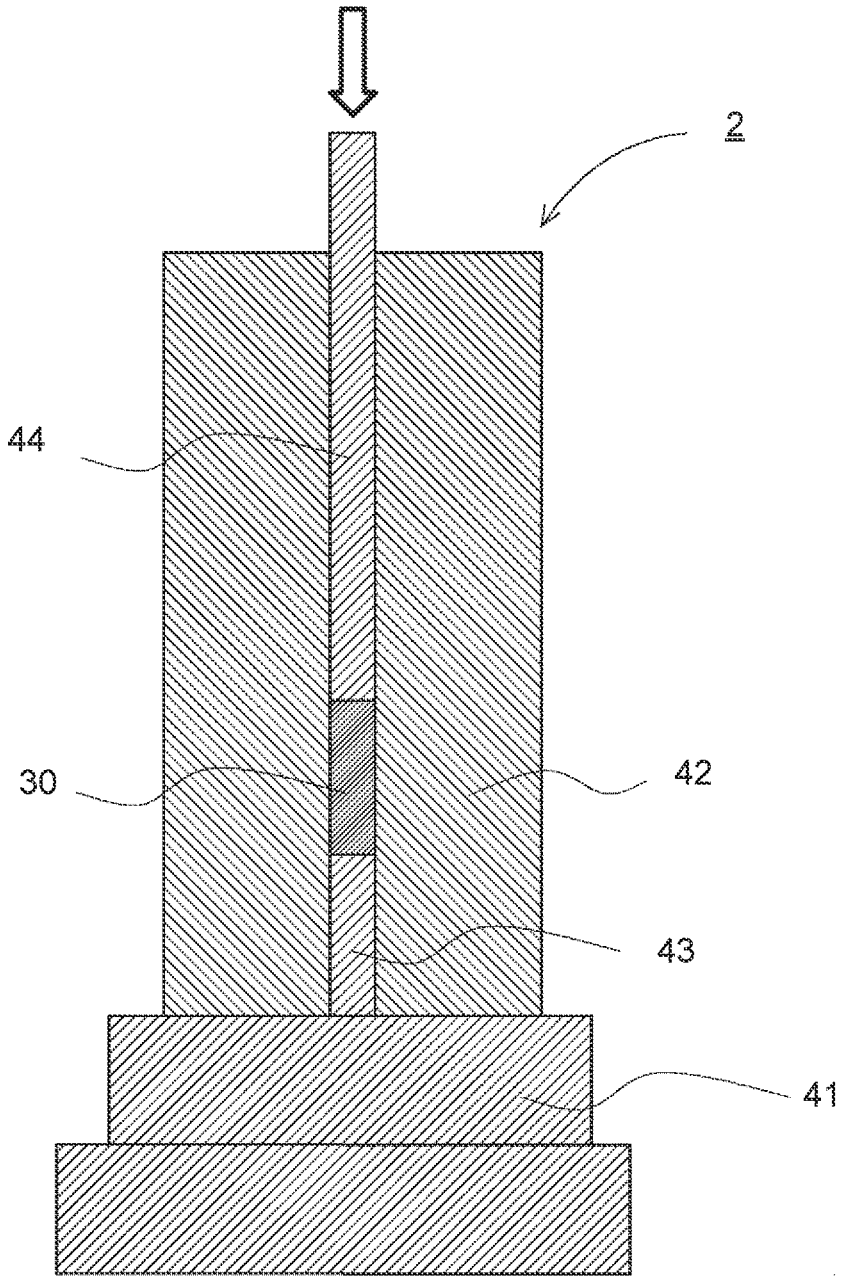
FIG. 9 is a schematic cross-sectional view of an evaluation apparatus for pressure transmission efficiency.

As Example 3, the present inventors evaluated an improvement effect of pressure transmission efficiency owing to the application of the lubricant by using an apparatus as illustrated in FIG. 9. FIG. 9 is a schematic cross-sectional view illustrating an example of a die to be used for molding a cylindrical salt core, and an evaluation method using the same. In this drawing, a reference sign 2 denotes a die. The die 2 includes a base 41, a cylindrical member 42 disposed on the base 41 and having a long and narrow cylindrical through hole formed along the central axis thereof, a dice 43 disposed on the bottom of the through hole of the cylindrical member 42, and a cylindrical pressing member 44 to be inserted into the through hole of the cylindrical member 42. A reference sign 30 denotes a molding material (slurry mixed material) to be charged onto the dice 43 in the through hole of the cylindrical member 42.

As the molding material, the slurry mixed material obtained in Example 1 when the mass of the saturated salt water added was 25 parts by mass was used. The through hole had a diameter of 15 mm, and the amount of the molded material to be charged was 35 g. The pressing member 44 was pressed from above, and a pressure having reached the bottom of the base 41 was measured by a pressure sensor installed on the bottom of the base 41. A pressure force applied to the pressing member 44 was 72 kN, and a pressing time was 60 seconds.

A pressure having reached the bottom of the base 41 by the pressure application without applying the lubricant onto the inner surface of the die was measured, and the pressure thus obtained was used as a reference value. A ratio, to this reference value, of a pressure having reached the bottom of the base 41 by the pressure application with the lubricant applied onto the inner surface of the die was obtained, and the thus obtained ratio was defined as the "pressure transmission efficiency ratio". The pressure transmission efficiency ratio obtained by the pressure application without applying the lubricant onto the inner surface of the die is "1".

Figure 10:
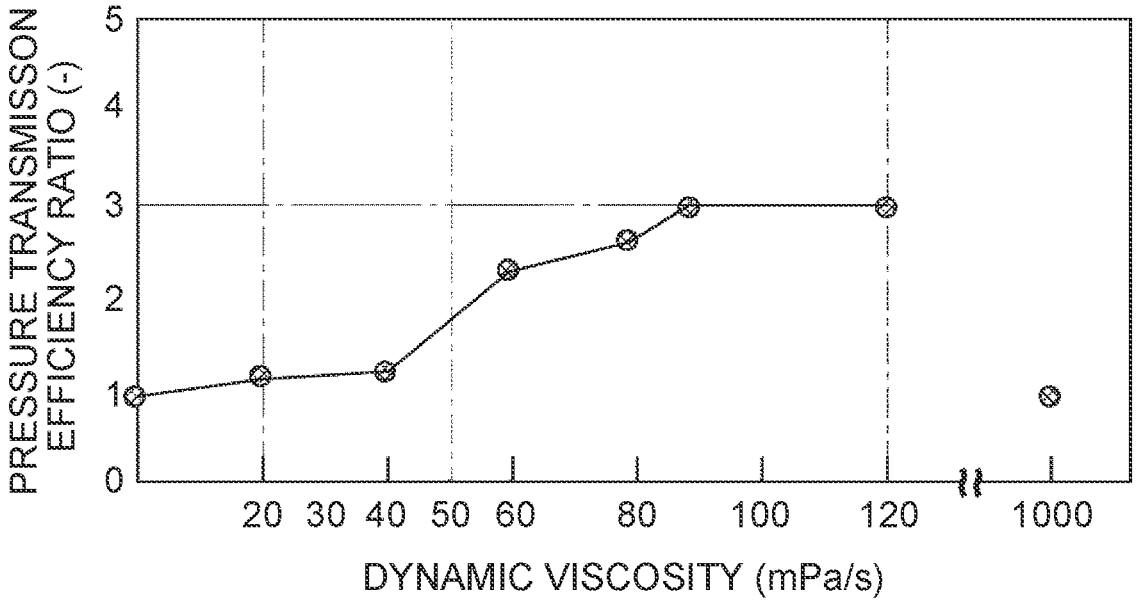
FIG. 10 is a graph illustrating the relationship between dynamic viscosity of a lubricant and a pressure transmission efficiency ratio.

With the type of lubricant variously changed, dynamic viscosities and pressure transmission efficiency ratios of respective lubricants were obtained, and thus, the relationship between the dynamic viscosity of the lubricant and the pressure transmission efficiency ratio was obtained. Evaluation results are illustrated in FIG. 10. The dynamic viscosity of each lubricant was data listed in the catalogue. When the dynamic viscosity of the lubricant was increased from 0 mPa·s, the pressure transmission efficiency ratio increased beyond 1 at a dynamic viscosity of 20 mPa·s or more.

Thereafter, as the dynamic viscosity of the lubricant is increased, the pressure transmission efficiency ratio increased, and when the dynamic viscosity of the lubricant was 50 mPa·s, the pressure transmission efficiency ratio increased to about 2, and when the dynamic viscosity of the lubricant was 60 mPa·s or more, the pressure transmission efficiency ratio increased beyond 2. Also thereafter, the pressure transmission efficiency ratio increased as the dynamic viscosity of the lubricant was increased, but the effect was saturated when the dynamic viscosity of the lubricant reached about 87 mPa·s, and at this point, the pressure transmission efficiency ratio was 3. In a range of the dynamic viscosity of the lubricant of at least 87 to 120 mPa·s, the pressure transmission efficiency ratio was 3. When the dynamic viscosity of the lubricant is too high, the lubricant is difficult to apply onto the inner surface of the die, and the handleability is deteriorated. For example, when the dynamic viscosity of the lubricant was 1000 mPa·s, the dynamic viscosity was too high, and hence the lubricant was difficult to apply onto the inner surface of the die, the handleability was deteriorated, and the improvement effect of the pressure transmission efficiency ratio could not be obtained. It was found, based on the results illustrated in FIG. 10, that the dynamic viscosity of the lubricant is preferably 20 to 120 mPa·s, more preferably 50 to 120 mPa·s, and particular preferably 60 to 100 mPa·s.

Step (C)

In the step (C), moisture is removed by drying the molded article obtained in the step (B). The drying can be performed by a known method. For example, drying by heating at 100 to 200° C. using an electric furnace or the like is preferred. In the step (B), a large part of the liquid content contained in the molding material (for example, about 90% of the whole molding material) is squeezed out by the pressure molding, but the resultant molded article contains a remaining portion of the salt water. In the step (C) of removing moisture by drying the molded article, the salt is recrystallized, and hence a core having a high density close to a single crystal can be produced.

As described so far, according to the present disclosure, a salt core can be produced with low energy, low cost and high productivity, and thus, a method for producing a salt core in which the salt core can be easily molded, and the degree of design freedom in shape of the salt core is high can be provided.

The present disclosure is not limited to the embodiment and examples described above, but can be appropriately changed and modified in design without departing from the spirit and scope of the present disclosure.

What is claimed is:

1. A method for producing a salt core, comprising:

a step A of adding a saturated sodium chloride aqueous solution to a sodium chloride crystal that is granular, to prepare a slurry mixed material of sodium chloride and water, where an amount of saturated sodium chloride aqueous solution is Ma parts by mass or more with respect to 100 parts by mass of sodium chloride crystal;

a step B of subjecting the slurry mixed material to pressure molding to obtain a molded article; and a step C of drying the molded article to remove moisture, wherein the Ma is determined based on a relationship between a mass of the saturated sodium chloride aqueous solution added with respect to 100 parts by mass of the sodium chloride crystal and a flow rate of a mixed material of sodium chloride and water when the mass added causes the flow rate to start increasing, found by increasing the mass added from 0 parts by mass.

2. The method for producing a salt core according to claim 1, wherein the amount of saturated sodium chloride aqueous solution is Mb parts by mass or more with respect to 100 parts by mass of sodium chloride crystal, wherein Mb is determined based on the relationship between the mass of the saturated sodium chloride aqueous solution added with respect to 100 parts by mass of the sodium chloride crystal when the flow rate first reaches a maximum rate, found by increasing the mass added from 0 parts by mass.

3. The method for producing a salt core according to claim 1, wherein the pressure molding is performed with a liquid content of the slurry mixed material discharged from both sides in a pressure applying direction in the step B.

4. The method for producing a salt core according to claim 3, wherein a die is provided with one or more discharge holes, and the liquid content is discharged through the one or more discharge holes.

5. The method for producing a salt core according to claim 1, wherein a lubricant that does not dissolve in water, is applied onto an inner surface of a die and then the slurry mixed material is charged into the die to perform the pressure molding in the step B.

6. The method for producing a salt core according to claim 5, wherein the lubricant has a dynamic viscosity of 20 to 120 mPa·s.

7. The method for producing a salt core according to claim 5, wherein the die is provided with one or more discharge holes, and a liquid content of the slurry mixed material is discharged through the one or more discharge holes.

* * * * *